United States Patent [19]

Orii

[11] Patent Number: 4,566,306

[45] Date of Patent: Jan. 28, 1986

[54] METHOD AND APPARATUS FOR FEEDING MATERIALS TO BE PRESSED

[75] Inventor: Masaru Orii, Machida, Japan

[73] Assignee: Yugengaisha Kyodogiken, Tokyo, Japan

[21] Appl. No.: 587,535

[22] Filed: Mar. 8, 1984

[30] Foreign Application Priority Data

Mar. 17, 1983 [JP] Japan ..... 58-43130
Mar. 17, 1983 [JP] Japan ..... 58-43131

[51] Int. Cl.[4] ..... B21D 43/10; B21D 45/00

[52] U.S. Cl. ..... 72/346; 72/405; 72/421; 72/422; 72/426; 100/207; 414/744 B

[58] Field of Search ..... 10/11 T, 12 T, 72 T, 10/76 T; 72/346, 405, 421, 422, 426; 100/207; 414/744 A, 744 B, 750, 751, 752, 917

[56] References Cited

U.S. PATENT DOCUMENTS

| | | | |
|---|---|---|---|
| 3,282,079 | 11/1966 | Kull | 72/421 X |
| 3,824,833 | 7/1974 | Bachmann | 414/744 A |
| 3,834,213 | 9/1974 | Henzler et al. | 72/421 X |
| 3,937,056 | 2/1976 | Henzler et al. | 72/405 |
| 3,948,162 | 4/1976 | Numba | 72/405 X |
| 3,960,276 | 6/1976 | Gerhardt | 414/752 X |
| 4,056,198 | 11/1977 | Boserup | 414/744 B |
| 4,361,413 | 11/1982 | Toda | 414/744 B |
| 4,462,741 | 7/1984 | Sogawa et al. | 72/422 X |
| 4,487,409 | 12/1984 | Orii | 414/752 X |

FOREIGN PATENT DOCUMENTS

| | | | |
|---|---|---|---|
| 2438960 | 2/1976 | Fed. Rep. of Germany | 414/752 |
| 2038681 | 7/1980 | United Kingdom | 72/422 |

*Primary Examiner*—E. Michael Combs
*Attorney, Agent, or Firm*—Collard, Roe & Galgano

[57] ABSTRACT

A method and apparatus is provided wherein a pressed material is withdrawn from a lower metal mold in a press in accordance with a horizontal, pivotal movement and a vertical, linear movement of a carry-out arm, and a material to be pressed is fed from a preceding stage to the press in accordance with a horizontal, pivotal movement and a vertical, linear movement of a carry-in arm. In this method of feeding a material to be pressed, the height of a path along which the carry-out arm is turned is set greater than that of a path along which the carry-in arm is turned. The operations of the carry-in arm and carry-out arm are timed in such a manner that a material being newly fed and a pressed material being removed are overlapped as they are vertically spaced at a predetermined distance from each other, in a position above a lower metal mold in the press.

14 Claims, 15 Drawing Figures

FIG. 8(A)
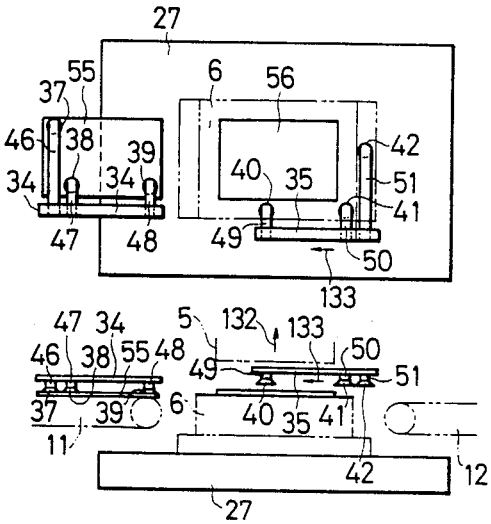
FIG. 8(B)
FIG. 9(A)
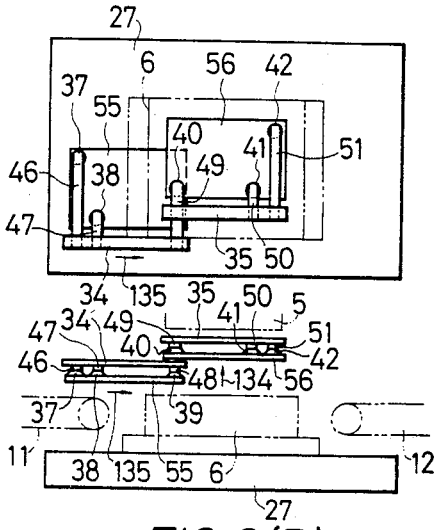
FIG. 9(B)
FIG. 10(A)
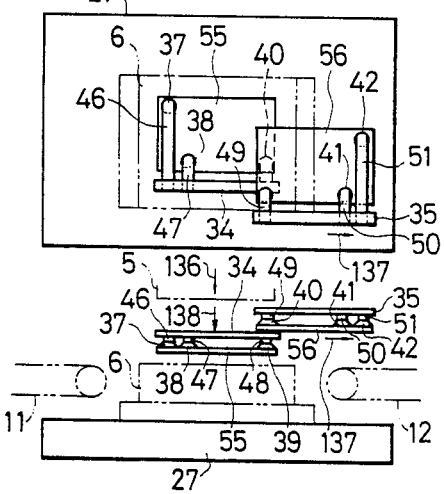
FIG. 10(B)
FIG. 11(A)
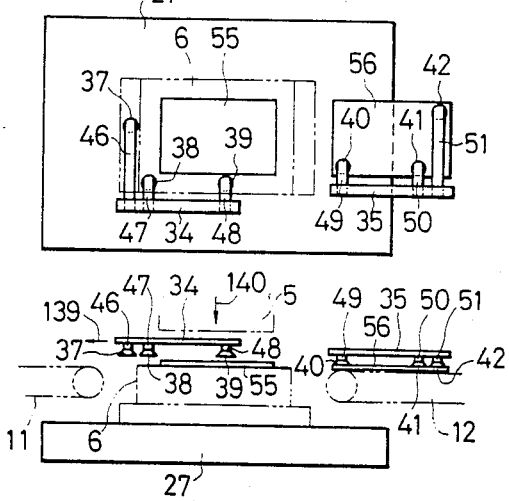
FIG. 11(B)

METHOD AND APPARATUS FOR FEEDING MATERIALS TO BE PRESSED

BACKGROUND OF THE INVENTION

1. Field of the Invention

This invention relates to a method and apparatus for feeding material to be pressed to a press or withdrawing pressed material therefrom, and more particularly to a method and apparatus for feeding a material to be pressed to a high speed press.

2. Description of the Prior Art

In a conventional method of feeding materials to be pressed, pressed material on a metal mold provided in a press is withdrawn therefrom by a carry-out arm and untreated material is then placed on the metal mold by a carry-in arm. After the material is pressed, the pressed material is withdrawn again in the same manner. The material to be pressed and the pressed material are fed onto and sent out from the metal mold in the mentioned order to carry out a pressing operation. In order to replace a pressed material on a metal mold with an untreated material, the pressed material is carried to the outside of a zone in which an upper metal mold is vertically moved, and the untreated material is then carried onto the metal mold to be inserted therein.

Therefore, it takes a great deal of time to replace pressed material with material to be pressed. In order to carry out such replacement of materials, it is necessary to reduce the speed of operation of the press or temporarily stop the operation thereof. This prevents an increase in the feed rate of materials to be pressed and the productivity of pressed materials.

In operation, when the pressed material on the metal mold is replaced with the material to be pressed, by the carry-out arm and the carry-in arm, each of which has a , means for gripping a substantially intermediate portion of the respective material, it is necessary that the movements of three parts, i.e. the gripper means on the carry-out arm, the gripper means on the carry-in arm, and the vertically displaceable upper metal mold do not obstruct one another in the space above the lower metal mold. Therefore, it is necessary to carry out the replacement of the pressed material with the material to be pressed, after the upper metal mold is lifted sufficiently, and lower the upper metal mold after the replacement of the material is completed with the gripper means on the carry-in arm moved to the outside of a zone in which the upper metal mold is moved downward.

Thus, in a conventional apparatus for feeding materials to be pressed, in which much time is required for carrying out the replacement of the material and the transfer of a gripper means to the outside of the zone of movement of the upper metal mold, the speed of operation of the press and the productivity of pressed materials cannot be increased.

Furthermore, the operation of replacing the metal mold in the press, which is done as necessary, becomes complicated since the operation is obstructed by the carry-in and carry-out means which are provided on the front surface of the bolster. Namely, the conventional apparatus for feeding materials to be pressed cannot adapt itself speedily to the re-arrangement of the production line.

SUMMARY OF THE INVENTION

An object of the present invention is to provide a method of feeding materials to be pressed, which is capable of feeding a unit quantity of material to be pressed, in a greatly shortened period of time, and following the high-speed continuous operation of the press.

Another object of the present invention is to provide an apparatus for feeding materials to be pressed, which is capable of feeding a unit quantity of material to be pressed, in a greatly shortened period of time, following the high-speed continuous operation of the press, and easily carrying out the re-arrangement of the press.

According to the present invention, the plane in which the carry-out arm is turned is set higher than that in which the carry-in arm is turned, and the carry-in arm is turned to a dead point of pivotal movement at the infeed terminating position thereof immediately after the upward movement of the carry-out arm is started in a dead point of pivotal movement at the outfeed starting position thereof. Namely, the actions of the carry-out arm and carry-in arm are timed in such a manner that the pressed material to be sent out by the carry-out arm and the untreated material to be introduced into the metal mold by the carry-in arm, are aligned with each other in a vertically spaced relationship in a position above the lower metal mold in the press. Accordingly, the time for feeding a unit quantity of materials to be pressed can be shortened, and the feeding of materials to be pressed can be done in accordance with the high-speed continuous operation of the press.

In an apparatus according to the present invention, a fulcrum for the pivotal movement of at least one of the carry-in and carry-out arms is set on the rear surface of the bolster of the press. Also, positions to which gripper means provided on the carry-in arm are applied on the material to be pressed, are determined in the circumferential portion thereof which enters a zone of movement of an upper mold in such a position that is in the vicinity of a dead point of pivotal movement of the carry-in arm at the infeed terminating thereof. Similarly, positions to which gripper means provided on the carry-out arm are applied on the pressed material, are determined in the circumferential portion thereof which enters the zone of movement of the upper mold in such a position that is in the vicinity of the dead point of pivotal movement of the carry-out arm at the carry-out outfeed starting position thereof. Thus, a space suitably used to carry out a metal mold exchanging operation is provided in front of the bolster, and the grippers on the carry-in and carry-out arms are adapted to be moved along the shortest possible paths to the outside of the zone of movement of the upper mold. Therefore, the time for feeding a unit quantity of materials to be pressed can be shortened greatly, and the re-arrangement of the press can be done speedily and easily as necessary. In addition, the productivity of pressed materials can be improved.

BRIEF DESCRIPTION OF THE DRAWINGS

The present invention will be described and understood more readily when considered together with the accompanying drawings, in which:

FIGS. 8A, 8B, 9A, 9B, 10A, 10B, 11A and 11B are plan views and front elevational views of examples of gripper means used in the present invention, and illustrate the procedure of feeding a material to be pressed and a pressed material.

DESCRIPTION OF THE PREFERRED EMBODIMENT

Figure 1:
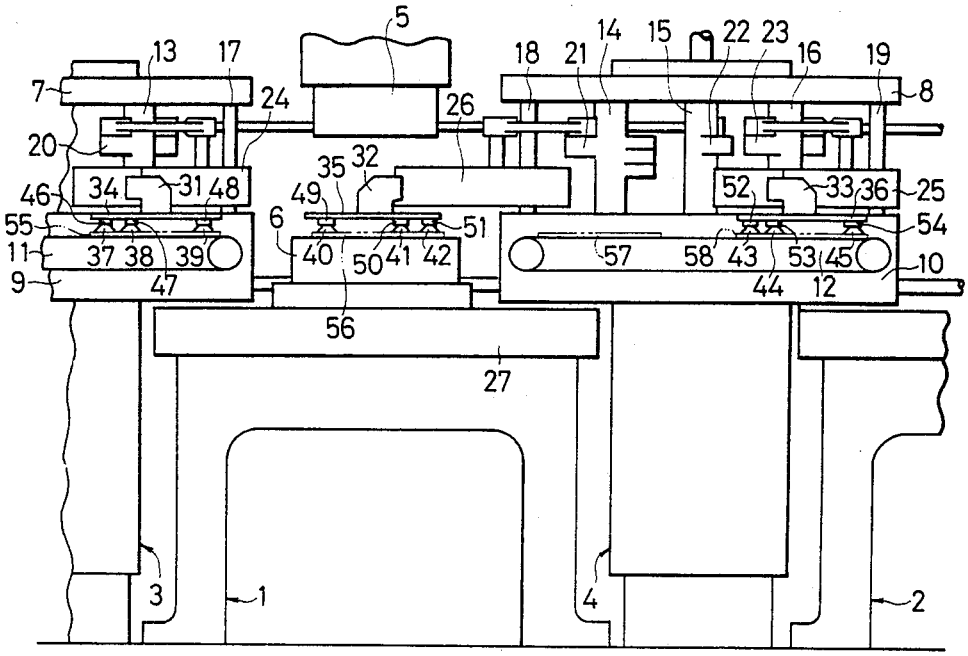
FIG. 1 is a front elevational view of the material feeding apparatus according to the present invention and a press.
Figure 2:
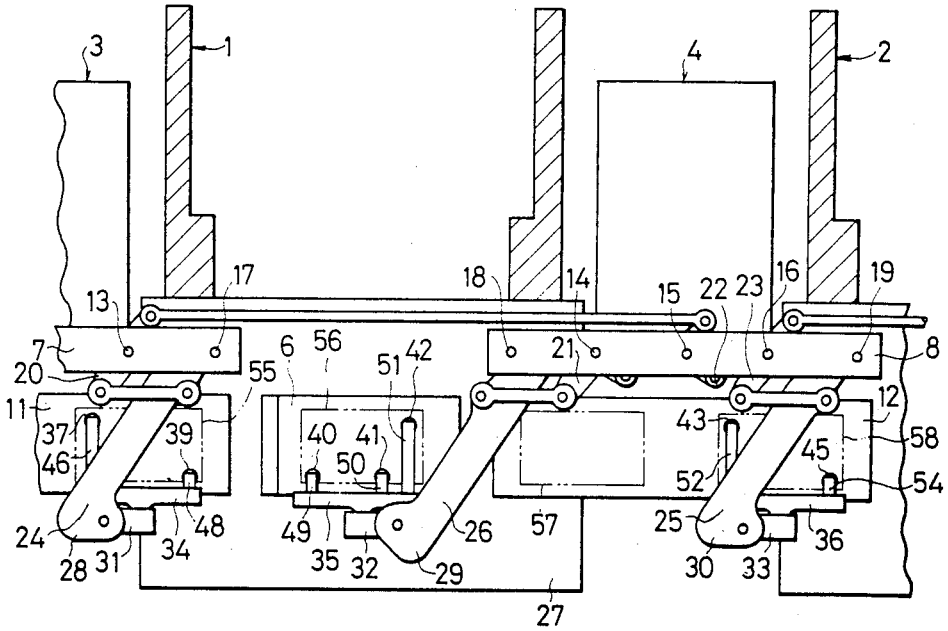
FIG. 2 is a plan view of the press and the material feeding apparatus shown in FIG. 1.

Referring to FIGS. 1 and 2, presses 1 and 2 and material feeding apparatus 3 and 4 are disposed adjacent to each other, and a series of pressing steps are carried out from the left-hand side of the figure to the right-hand side thereof. An upper metal mold 5 and a lower metal mold 6 are set on the presses 1 and 2 (upper and lower metal molds of press 2 are not shown), respectively. Upper bearings 7 and 8, lower bearings 9 and 10, and belt conveyors 11 and 12 are provided at the front sides of the material feeding apparatus 3 and 4.

Pivots 13, 14, 15 and 16, which are turned to the left and the right alternately at a predetermined angle, and fulcrum shafts 17, 18 and 19, which are moved vertically within a predetermined distance, are supported between upper bearings 7 and 8 and lower bearings 9 and 10 in the apparatus 3 and 4.

Pivots 13, 14, 15 and 16 have levers 20, 21, 22 and 23, respectively, which are formed integrally therewith. Carry-in arms 24 and 25 are mounted on fulcrum shafts 17 and 19, respectively, and a carry-out arm 26 on fulcrum shaft 18. These arms 24, 25 and 26 are adapted to be turned horizontally around and moved vertically with fulcrum shafts 17, 18 and 19. Namely, carry-in arms 24 and 25 and carry-out arm 26 are moved pivotally and vertically by fulcrum shafts 17, 18 and 19 working as fulcrums for the pivotal movements thereof and provided on the rear surface of bolster 27. The driving systems for moving carry-in arm 24 and carry-out arm 26 pivotally or vertically will be described later with reference to FIGS. 6 and 7.

Finger holders 34, 35 and 36 are attached to free end portions 28, 29 and 30 of carry-in arms 24 and 25 and carry-out arm 26 via support members 31, 32 and 33. Fingers 46, 47, 48, 49, 50, 51, 52, 53 and 54 having adsorber cups 37, 38, 39, 40, 41, 42, 43, 44 and 45 as gripper means are fixed to finger holders 34, 35 and 36. What are shown as two-dot-dash lines and designated by reference numerals 55, 56, 57 and 58 are materials to be pressed and pressed materials.

The material 58 to be pressed is held by adsorber cups 43, 44 and 45 and fed from belt conveyor 12 to a lower metal mold (not shown) in press 2 by carry-in arm 25. The material 57 is transferred by belt conveyor 12 to the position of material 58.

The pressed material 56 is held by adsorber cups 40, 41 and 42 to be withdrawn from lower metal mold 6 in press 1 by carry-out arm 26 and transferred to the position of the material 57 on belt conveyor 12. The material 55 to be pressed is held by the adsorber cups 37, 38 and 39 to be fed from belt conveyor 11 to lower metal mold 6 in press 1 by carry-in arm 24. In this embodiment, the fulcrums for the pivotal movements of carry-in arms 24 and 25 and carry-out arm 26 are set on the rear surface of the bolster 27. Even when either carry-in arms 24 and 25 or carry-out arm 26 is provided on the front surface of bolster 27, presses 1 and 2 and material feeding apparatus 3 and 4 can be set without losing the space required to carry out the replacement of the upper and lower metal molds.

Figure 3:
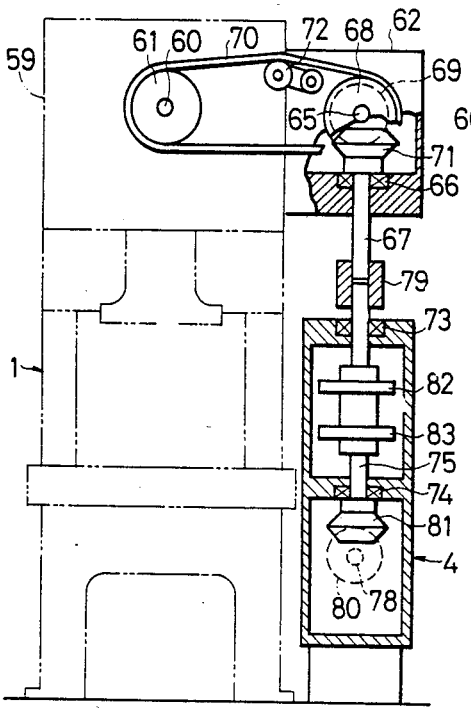
FIG. 3 is a front elevational view, partly in section, of the power transmission mechanism for the material feeding apparatus shown in FIG. 1.
Figure 4:
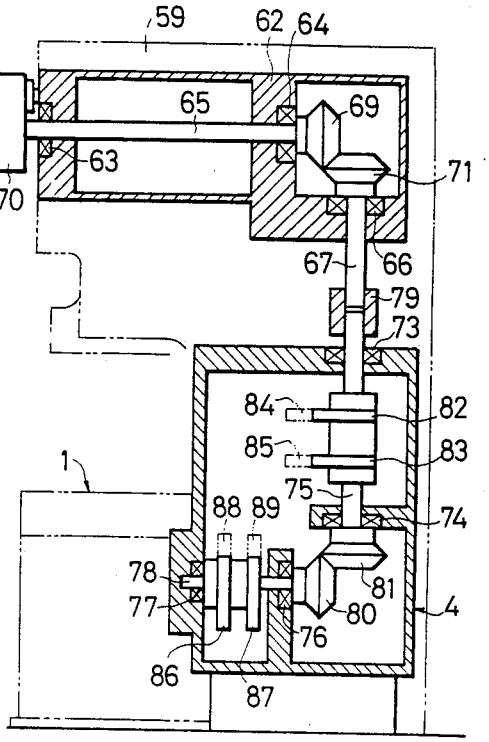
FIG. 4 is a side elevational view in section, of the power transmission mechanism for the material feeding apparatus shown in FIG. 3.
Figure 5:
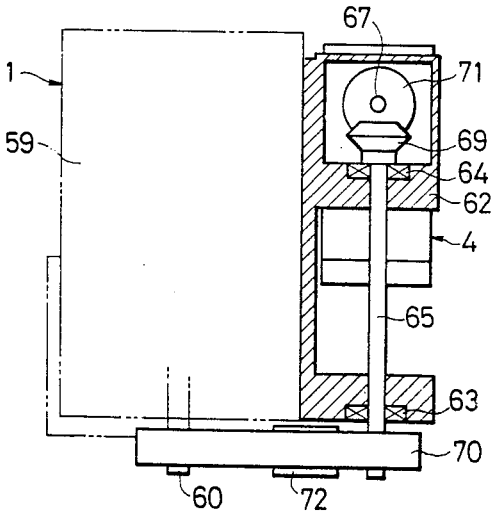
FIG. 5 is a top plan view in section of the power transmission mechanism for the material feeding apparatus shown in FIG. 3.

Referring to FIGS. 3, 4 and 5, an output shaft 60, which is driven in accordance with the operation of press 1 by the drive power source for press 1, extends outward from the front surface of an upper frame 59 of press 1. The output shaft 60 is rotated in unison with a gear pulley 61.

An intermediate shaft 65 extending horizontally and rotatably supported on bearings 63 and 64, and another intermediate shaft 67 extending downward and rotatably supported on a bearing 66 are housed in a side frame 62 formed integrally with press 1.

A gear pulley 68 and bevel gear 69 are fixedly mounted on both end portions of intermediate shaft 65. Gear pulley 68 and gear pulley 61 mounted on output shaft 60 are connected together by a timing belt 70, and bevel gear 69 is connected to bevel gear 71 fixedly mounted on an upper end portion of intermediate shaft 67. Reference numeral 72 denotes a tightener or tensioner for timing belt 70.

Material feeding apparatus 4 is provided with a vertical cam shaft 75 rotatably supported on bearings 73 and 74, and a horizontal cam shaft 78 rotatably supported on bearings 76 and 77.

Vertical cam shaft 75 is connected at its upper end to intermediate shaft 67 via a coupling 79, and is provided at its lower end with a bevel gear 81 mounted fixedly thereon and connected to a bevel gear 80 mounted fixedly on an inner end of horizontal cam shaft 78.

Two lever-pivoting cams 82 and 83 are formed on vertical cam shaft 75, and contact at their curved outer circumferential surfaces cam rollers 84 and 85 shown by dot-dash lines. Cam roller 84 belongs to the drive system for turning carry-in arm 24, and cam roller 85 to the drive system for turning carry-out arm 26.

Two lever-lifting-and-lowering-cams 86 and 87 are formed on horizontal cam shaft 78, and contact at their curved outer circumferential surfaces cam rollers 88 and 89 shown by dot-dash lines. Cam roller 88 belongs to the drive system for vertically moving carry-in arm 24, and cam roller 89 to the drive system for vertically moving carry-out arm 26.

Figure 6:
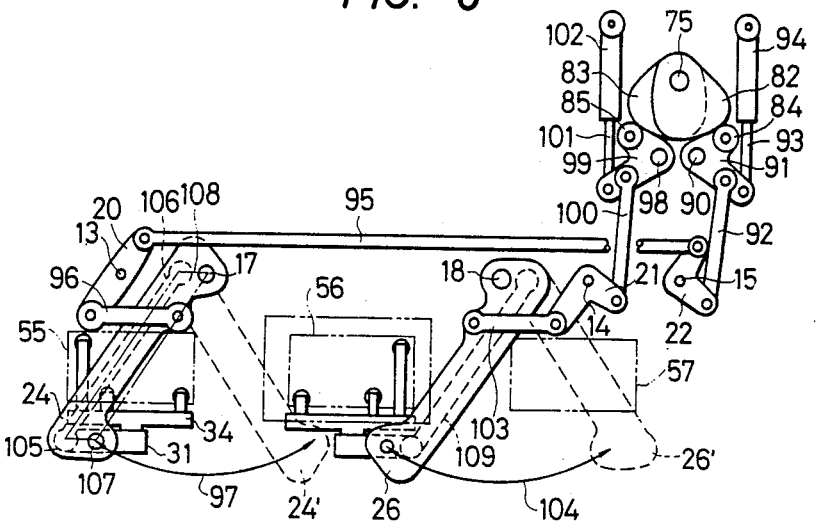
FIG. 6 is a plan view of a driving system for pivotally moving the carry-in and carry-out arms of the material feeding apparatus shown in FIGS. 1 and 2.

FIG. 6 shows the drive systems for turning carry-in arm 24 and carry-out arm 26 shown in FIGS. 1 and 2. The parts shown in FIG. 6 and identical with those shown in FIGS. 1–5 are designated by the same reference numerals.

First, the drive system for turning carry-in arm 24 will be described.

Cam roller 84 contacting lever-pivoting cam 82 is fixed to one end of a lever 91, which is provided in the material feeding apparatus 4 in such a manner that the lever can be turned around a fulcrum pin 90, and links 92 and 93 are connected at one end of each thereof to the other end of lever 91. Link 92 is connected at the other end thereof to one end of lever 22 supported rotatably on upper bearing 8 and lower bearing 10 in material feeding apparatus 4 and formed integrally with pivot 15. Link 93 is connected at the other end thereof to an air cylinder 94. Air cylinder 94 is fixed at one end thereof to material feeding apparatus 4 and is adapted to urge lever 91, which is driven by lever-pivoting cam 82, in the direction in which lever 91 is 1 returned to its original posltion.

The other end of lever 22 and one end of lever 20 supported rotatably on upper bearing 7 and lower bearing 9 in material feeding apparatus 3 and formed integrally with pivot 13 are connected together by a link 95. The other end of the lever 20 is connected to carry-in arm 24 by a link 96.

The drive system for turning carry-in arm 24 is formed by the parts connected in the above-described manner. A continuous action of lever 91, which is adapted to be driven by a pivotal movement of lever-pivoting cam 82 and returned by air cylinder 94, is transmitted to carry-in arm 24, so that carry-in arm 24 is turned to the right and left as shown by an arrow 97 around fulcrum shaft 17 between a position shown by a full line and a position shown by a broken line 24'.

The drive system for turning carry-out arm 26 will now be described.

Cam roller 85 contacting lever-pivoting cam 83 is fixed to one end of a lever 99, which is provided in material feeding apparatus 4 in such a manner that lever 99 can be turned around a fulcrum pin 98, and links 100 and 101 are connected at one end of each thereof to the other end of lever 99. Link 100 is connected at the other end thereof to one end of lever 21 supported rotatably on upper bearing 8 and lower bearing 10 in material feeding apparatus 4 and formed integrally with pivot 14. Link 101 is connected at the kther end thereof to an air cylinder 102. Air cylinder 102 is fixed at one end thereof to material feeding apparatus 4 and is adapted to urge lever 99, which is driven by lever-pivoting cam 83, in the direction in which lever 99 is returned to its original position. The other end of lever 21 and carry-out arm 26 are connected to each other by a link 103.

The drive system for turning carry-out arm 26 is formed by the parts connected in the above-described manner. A continuous action of lever 99, which is adapted to be driven by a pivotal movement of lever-pivoting cam 83 and returned by air cylinder 102, is transmitted to carry-out arm 26, so that carry-out arm 26 is turned to right and left as shown by an arrow 104 around fulcrum shaft 18 between a position shown by a full line and a position shown by a broken line 26'.

A parallel link 106, one end of which is pivotably supported on lower bearing 9, and the other end of which is connected to an inner end portion 105 of support member 31, is provided in parallel with carry-in arm 24. Consequently, a parallelogram 108 shown by a dot-dash chain line, one side of which consists of a straight line connecting fulcrum shaft 17 of carry-in arm 24 and the axis of a pin 107 by which support member 31 is connected to the free end portion 28 of carry-in arm 24, is formed. Accordingly, finger holder 34 is not turned during a pivotal movement of carry-in arm 24, so that material 55 to be pressed can be fed in parallel with both edges of the belt conveyors. Reference numeral 109 denotes a parallel link provided in carry-out arm 26 and working in the same manner as parallel link 106.

Figure 7:
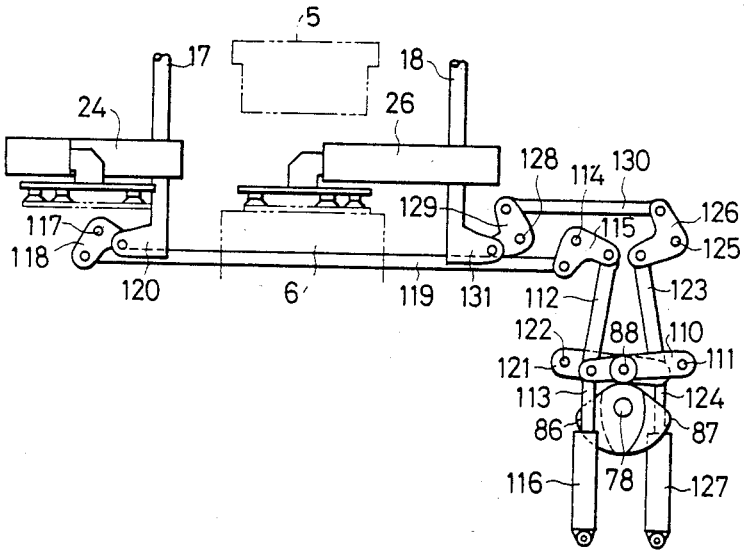
FIG. 7 is a front elevational view of a drive system for vertically moving the carry-in and carry-out arms shown in FIG. 6.

FIG. 7 is a diagram showing the drive systems for vertically moving carry-in arm 24 and carry-out arm 26 shown in FIG. 6. The parts shown in FIG. 7 and identical with those shown in FIGS. 1–6 are designated by the same reference numerals.

First, the drive system for vertically moving the carry-in arm 24 will be described.

A lever 110 is connected pivotably at its one end to material feeding apparatus 4 via a fulcrum pin 111, and links 112 and 113 at one end of each thereof to the other end of lever 110. Cam roller 88 contacting lever-lifting-and-lowering-cam 86 is fixed to a substantially intermediate portion of lever 110.

The other end of link 112 is connected to one end of a lever 115, which is supported pivotably on lower bearing 10 in material feeding apparatus 4 via a fulcrum pin 114, and the other end of link 113 to an air cylinder 116. Air cylinder 116 is fixed at its one end to apparatus 4 and is adapted to urge lever 110, which is driven by lever-lifting-and-lowering-cam 86, in the direction in which lever 110 is returned to its original position.

The other end of lever 115 and one end of a lever 118, which is supported pivotably on lower bearing 9 in material feeding apparatus 3 via a pin 117, are connected together via a link 119. The other end of lever 118 is connected to a connecting portion 120 formed at a lower end of fulcrum shaft 17, which is supported on upper bearing 7 and lower bearing 9 in apparatus 3 and is adapted to be moved in unison with carry-in arm 24 in the vertical direction.

The drive system for vertically moving carry-in arm 24 is formed by the parts connected together in the above-described manner. A continuous action of lever 110 driven by a pivotal movement of lever-lifting-and-lowering-cam 86 and returned by air cylinder 116 is transmitted to carry-in arm 24, so that carry-in arm 24 is moved vertically.

The drive system for vertically moving carry-out arm 26 will now be described.

A lever 121 is fixed pivotably at its one end to material feeding apparatus 4 via a fulcrum pin 122, and links 123 and 124 are connected at one end of each thereof to the other end of lever 121. Cam roller 89 contacting lever-lifting-and-lowering-cam 87 is fixed to a substantially intermediate portion of lever 121. Since cam roller 89 is positioned on the same axis as cam roller 88, it is not shown in the drawing.

The other end of link 123 is connected to one end of a lever 126, which is supported pivotably on lower bearing 10 in material feeding apparatus 4 via a fulcrum pin 125, and the other end of link 124 to an air cylinder 127. Air cylinder 127 is fixed at one end thereof to apparatus 4 and is adapted to urge lever 121, which is driven by lever-lifting-and-lowering-cam 87, in the direction in which lever 121 is returned to its original position.

The other end of the lever and one end of a lever 129, which is supported pivotably on lower bearing 10 in material feeding apparatus 4 via a pin 128, are connected together by a link 130. The other end of lever 129 is connected to a connecting portion 131 formed at a lower end of fulcrum shaft 18, which is supported on upper bearing 8 and lower bearing 10 in apparatus 4 in such a manner that fulcrum shaft 18 is moved in unison with carry-out arm 26 in the vertical direction.

The drive system for vertically moving carry-out arm 26 is formed by the parts connected together in the above-described manner. A continuous action of lever 121, which is driven by a pivotal movement of lever-lifting-and-lowering-cam 87 and returned to its original position by air cylinder 127, is transmitted to carry-out arm 26, so that carry-out arm 26 is moved vertically.

When press 1 is operated, carry-out arm 24 and carry-in arm 26 are moved pivotally in the horizontal direction and linearly in the vertical direction, respectively, in accordance with the operations of lever pivoting cams 82 and 83 and lever-lifting-and-lowering-cams 86 and 87, which are performed by the above-described drive systems. Thus, material 55 to be pressed, which is held by adsorber cups 37, 38 and 39, is fed to lower metal mold 6, and pressed material 56 held by the adsorber cups 40, 41 and 42 is withdrawn therefrom.

Material 57 is fed to the right by belt conveyor 12, and material 58, held by adsorber cups 43, 44 and 45, is fed from belt conveyor 12 to press 2 by carry-in arm 25, which is actuated by the drive system provided in the material feeding apparatus (not shown) in press 2.

FIGS. 8, 9, 10 and 11, each of which consists of a plan view (A) and a front elevational view (B), show examples of gripper means used in the present invention and the order of material feeding operations.

The order of material feeding operations will now be described with reference to FIGS. 1–7 as well.

Referring to FIG. 8, when the pressing work for material 56 is completed by press 1, upper metal mold 5 starts being lifted in the direction of arrow 132. Material 55 to be pressed, which is on belt conveyor 11, is held by adsorber cups 37, 38 and 39 provided on carry-in arm 24 in a dead point (position shown by a full line in FIG. 6) of pivotal movement of carry-in arm 24 at the infeed starting position thereof. Material 55 to be pressed is held at the two front portions of an outer circumferential section thereof which are the closest to finger holder 34 and at one left rear portion of the outer circumferential section thereof. Accordingly, finger 46 in use, which has adsorber cup 37, is made long.

Adsorber cups 40, 41 and 42 on carry-out arm 26 are moved pivotally from a low position close to pressed material 56 on lower metal mold 6 to a dead point (position shown by a full line in FIG. 6) of pivotal movement of carry-out arm 26 at the outfeed starting position thereof, i.e. in the direction of arrow 133.

Referring to FIG. 9, when upper metal mold 5 in press 1 is moved to an upper dead point and pressed material 56, which is held by adsorber cups 40, 41 and 42 on carry-out arm 26, is moved upward as shown by arrow 134, material 55 to be pressed, which is held by the adsorber cups 37, 38 and 39 on carry-in arm 24, is moved pivotally at once from a position lower than pressed material 56 in the direction of arrow 135 to be fed onto lower metal mold 6. Pressed material 56 to be sent out by carry-out arm 26 is held at the two front portions of an outer circumferential section thereof which are the closest to finger holder 35 and at one right rear portion of an outer circumferential section thereof. Accordingly, finger 51 in use, which has adsorber cup 42, is made long in the same way as finger 46 on carry-in arm 24.

Since the positions of adsorber cups 37, 38 and 39 on carry-in arm 24 are set as shown in FIG. 8, adsorber cups 37, 38 and 39 and fingers 46, 47 and 48 do not cross a zone of movement of upper metal mold 5, and material 55 to be pressed can be fed onto lower metal mold 6 along the shortest path to the mentioned zone. Since the positions of adsorber cups 40, 41 and 42 on carry-out arm 26 are set as shown in FIG. 9, adsorber cups 40, 41 and 42 and fingers 49, 50 and 51 do not cross a zone of movement of upper mold 5, and the pressed material on lower metal mold 6 can be held by these cups 40, 41 and 42 entering the zone of movement of upper metal mold 5 along the shortest path thereto.

Referring to FIG. 10, when upper metal mold 5 starts being lowered as shown by arrow 136, for carrying out a subsequent operation, pressed material 56 held by adsorber cups 40, 41 and 42 is moved pivotally from a higher feed position in the rightward direction as shown by arrow 137, to be taken out in a position which is out of a zone of downward movement of upper metal mold 5. When carry-in arm 24 is turned to a dead point (position shown by a broken line in FIG. 6) of pivotal movement thereof at the infeed terminating position thereof, material 55 to be pressed is fed onto lower metal mold 6. Material 55 is then lowered in the direction of arrow 138 in accordance with a slight downward movement of carry-in arm 24 to be placed on a pressing position on lower metal mold 6.

Referring to FIG. 11, a carry-out action of carry-out arm 26 turned to the dead pont (position shown by a broken line in FIG. 6) of pivotal movement thereof at the outfeed terminating position thereof is completed, and pressed material 56 held by adsorber cups 40, 41 and 42 is carried onto belt conveyor 12 to be sent to a subsequent stage. Adsorber cups 37, 38 and 39, by which the positioning of material 55 has been completed, are turned by carry-in arm 24 from a low return position in the direction of arrow 139 to be removed to a position outside of a zone of downward movement of upper metal mold 5. Since adsorber cups 37, 38 and 39 and fingers 46, 47 and 48 are set in the positions mentioned with reference to FIG. 8, they can be moved instantly to positions out of the zone of movement of upper metal mold 5. Upper metal mold 5 continues to be moved downward as shown by arrow 140 to press material 55.

The action described above with reference to FIGS. 8–11, which constitutes one cycle of press work, is repated to press materials in order. Material 55 to be pressed is fed onto lower metal mold 6 immediately after pressed material 56 is lifted slightly therefrom. Accordingly, materials 55 and 56 do not obstruct each other in spite of the fact that they are aligned vertically within a zone of movement of upper metal mold 5. Moreover, material 56 can be replaced by material 55 within one stroke of upward or downward movement of upper metal mold 5; a speed of a downward movement of upper metal mold 5 need not be reduced, nor need the mold 5 be stopped temporarily, for carrying out the replacement of these materials 55 and 56. In addition, pressed material 56 can be held in the shortest time to be sent out, and finger holder 34 with adsorber cups 37, 38 and 39, which are provided on carry-in arm 24 used to feed material 55 to be pressed onto the lower metal mold, can be removed to positions outside of a zone of movement of upper metal mold 5.

In the embodiment shown in FIGS. 1–7, carry-in arms 24 and 25 and carry-out arms 26 are designed so as to be turned or vertically moved by drive systems mechanically connected thereto. These arms 24, 25 and 26 may be operated by hydraulic driving systems or electric driving systems using servomotors.

Vacuum adsorber cups 37, 38, 39, 40, 41, 42, 43, 44 and 45 are used as gripper means, which can be substituted by electromagnetic adsorbers or means for mechanically holding a material.

What is claimed is:

1. An apparatus for feeding materials to be pressed in an upper and lower metal mold, said apparatus having a carry-in arm and a carry-out arm, which have an infeed terminating position and an outfeed starting position, respectively, and which are provided with gripper means and moved pivotally in a horizontal direction and linearly in a vertical direction to feed a material to be pressed to and withdraw a pressed material from a press, comprising a fulcrum for a pivotal movement of at least one of said carry-in arm and said carry-out arm mounted on a rear surface of a bolster of said press, first gripper means provided on said carry-in arm for gripping a material to be pressed at peripheral positions thereof, said first gripper means and said material to be pressed entering a zone of movement of said upper metal mold in such a position that is in the vicinity of a dead point of pivotal movement of said carry-in arm at the infeed terminating position thereof, second gripper means provided on said carry-out arm for gripping a pressed material at peripheral positions thereof, said second gripper means and said pressed material entering a zone of movement of said upper metal mold in such a position that is in the vicinity of a dead point of pivotal movement of said carry-out arm at the outfeed starting position thereof, and means for timing the movements of the carry-in and carry-out arms so that the pressed material removed from said lower metal mold by the carry-out arm and the material to be pressed which is inserted into the press by the carry-in arm are aligned in a predetermined, vertically spaced relationship in a position above said lower metal mold in said press.

2. An apparatus for feeding material to be pressed according to claim 1, wherein a fulcrum for pivotal movement of said carry-in arm is mounted on the rear surface of said bolster of said press, and a fulcrum for pivotal movement of said carry-out arm is mounted on the rear surface of said bolster of said press.

3. An apparatus for feeding materials to be pressed according to claim 1, wherein said first and second gripper means comprise vacuum adsorber cups.

4. An apparatus for feeding materials to be pressed according to claim 1 wherein said first and second gripper means consists of electromagnetic adsorbers.

5. An apparatus for feeding materials to be pressed according to claim 1, wherein a first and second gripper means are fixed to free ends of said carry-in arm and said carry-out arm via support members, finger holders and fingers.

6. An apparatus for feeding materials to be pressed according to claim 5, wherein said apparatus includes a fist link mechanism forming a parallelogram one side of which consists of said carry-in arm, and a second link meachanism forming a parallelogram one side of which consists of said carry-out arm, said support members being fixed to such sides of said first and second link mechanisms that are parallel to stationary sides thereof.

7. An apparatus for feeding materials to be pressed according to claim 6, wherein said first and second gripper means are provided on portions of said carry-in arm and said carry-out arm which are spaced from free ends thereof toward fulcrums of pivotal movements thereof.

8. An apparatus for feeding materials to be pressed according to claim 1, wherein said first and second gripper means are comprised of three gripping elements.

9. An apparatus for feeding materials to be pressed according to claim 1, wherein shafts serving as fulcrums on which said carry-in arm and said carry-out arm are turned are provided, said carry-in arm and said carry-out arm being mounted on said fulcrum shafts in such a manner that said carry-in arm and said carry-out arm can be moved pivotally therearound in the horizontal direction and linearly therewith in the vertical directon.

10. An apparatus for feeding materials to be pressed according to claim 9, wherein drive systems for turning said carry-in arm and said carry-out arm are provided, said drive systems including two coaxially driven lever pivolting cams for timing the pivotal movments of said arms.

11. An apparatus for feeding materials to be pressed according to claim 10, wherein drive systems for vertically moving said carry-in arm and said carry-out arm are provided, said drive systems including two coaxially driven lever-lifting-and-lowering-cams for timing the vertical movements of said arms.

12. A method for feeding materials to be pressed, comprising the steps of withdrawing a pressed material from a lower metal mold in a press in accordance with a horizontal, pivotal movement and a vertical, linear movement of a carry-out arm having outfeed starting and terminating positions, and feeding a material to be pressed from a preceding stage to said press in accordance with a horizontal, pivotal movement and a vertical, linear movement of a carry-in arm having infeed starting and terminating positions, setting the height of a path along which said carry-out arm is turned greater than that of a path along which said carry-in arm is turned, and turning said carry-in arm to a dead point of pivotal movement thereof at the infeed terminating position thereof immediately after an upward movement of said carry-out arm is started in a dead point of pivotal movement thereof at the outfeed starting position thereof, so as to time the actions of said carry-out arm and said carry-in arm in such a manner that a pressed material removed by said carry-out arm and a material to be pressed, which is newly fed by said carry-in arm, are aligned with each other as they are spaced vertically at a predetermined distance from each other in a position above said lower metal mold in said press.

13. A method for feeding materials to be pressed according to claim 12, wherein said method includes a first step of holding by said carry-in arm a material to be pressed, which is in the infeed starting position, to feed said material to said lower metal mold along a lower path of pivotal movement of said carry-in arm, while holding a pressed material on said lower metal mold by said carry-out arm to lift the same material to a higher path of pivotal movement thereof, during a period of time which starts with the finishing of the press work and the beginning of an upward movement of an upper metal mold and which ends with the finishing of the upward movement of said upper metal mold; and a second step of feeding a material to be pressed to said lower metal mold by said carry-in arm, returning said carry-in arm to the infeed starting position, removing a pressed material to the outfeed terminating position by said carry-out arm, and moving said carry-out arm to the outfeed starting position, during a downward movement of said upper metal mold.

14. A method for feeding materials to be pressed according to claim 13, further comprising overlapping vertically a material to be pressed which is fed onto said lower metal mold by said carry-in arm, and a pressed material removed therefrom by said carry-out arm in a position in the vicinity of an upper dead point of said upper metal mold.

* * * * *